US007500477B2

(12) United States Patent
Westmeyer et al.

(10) Patent No.: US 7,500,477 B2
(45) Date of Patent: Mar. 10, 2009

(54) METHOD AND APPARATUS FOR MOVING A MASS

(76) Inventors: Paul A. Westmeyer, 9012 Horton Rd., Laurel, MD (US) 20708-2806; Renee Mazaheri, 9012 Horton Rd., Laurel, MD (US) 20708-2806

( * ) Notice: Subject to any disclaimer, the term of this patent is extended or adjusted under 35 U.S.C. 154(b) by 477 days.

(21) Appl. No.: 11/156,693

(22) Filed: Jun. 20, 2005

(65) Prior Publication Data

US 2005/0249576 A1 Nov. 10, 2005

Related U.S. Application Data

(62) Division of application No. 10/442,038, filed on May 20, 2003, now Pat. No. 7,013,988.

(60) Provisional application No. 60/383,632, filed on May 28, 2002.

(51) Int. Cl.
*F41B 3/04* (2006.01)

(52) U.S. Cl. ..... 124/6; 124/6; 244/171.1; 42/105

(58) Field of Classification Search ..... 124/4, 124/6, 81, 83; 244/158.5, 171.1, 171.7; 42/105
See application file for complete search history.

(56) References Cited

U.S. PATENT DOCUMENTS 1,201,626 A * 10/1916 Reynolds et al. ..... 124/6
2,684,062 A 7/1954 Rose
3,845,665 A 11/1974 Cappetta et al.
4,429,612 A 2/1984 Tidman et al.
4,590,842 A 5/1986 Goldstein et al.
4,715,261 A 12/1987 Goldstein et al.
4,795,113 A 1/1989 Minovitch
4,821,508 A 4/1989 Burton et al.
4,821,509 A 4/1989 Burton et al.
4,897,558 A 1/1990 Tidman
4,901,621 A 2/1990 Tidman
4,907,487 A 3/1990 Tidman et al.
4,913,029 A 4/1990 Tidman et al.
4,917,335 A 4/1990 Tidman
4,974,487 A 12/1990 Goldstein et al.
5,012,719 A 5/1991 Goldstein et al.
5,012,720 A 5/1991 Tidman
5,033,355 A 7/1991 Goldstein et al.
5,429,030 A 7/1995 Tidman
5,699,779 A * 12/1997 Tidman ..... 124/6
5,703,322 A 12/1997 Tidman (Continued)

OTHER PUBLICATIONS

NASA; STA; General Public Space travel and Tourism—vol. 1 Executive Summary; Feb. 19-21, 1997.

(Continued)

*Primary Examiner*—Bret Hayes
*Assistant Examiner*—Benjamin P Lee
(74) *Attorney, Agent, or Firm*—Emch, Schaffer, Schaub & Porcello Co. L.P.A.

(57) ABSTRACT

A combination for performing a variety of functions includes (a) apparatus for moving a projectile or other mass along an arcuate path and moving the path substantially radially along a local radius of curvature and (b) a tool, vehicle or other article for receiving such projectile and being moved thereby.

5 Claims, 10 Drawing Sheets

U.S. PATENT DOCUMENTS

| | | | | |
|---|---|---|---|---|
| 5,819,715 | A * | 10/1998 | Haneda et al. | 124/6 |
| 5,950,608 | A | 9/1999 | Tidman | |
| 6,014,964 | A | 1/2000 | Tidman | |
| 6,712,055 | B1 | 3/2004 | Tidman | |
| 7,032,584 | B2 * | 4/2006 | Tidman et al. | 124/6 |
| 2005/0172943 | A1 * | 8/2005 | Cucjen et al. | 124/6 |

OTHER PUBLICATIONS

NASA/CP—1998-209006; New Space Industries For The Next Millennium; D.V. Simtherman, Jr.,; Marshall Space Flight Center, Marshall Space Flight Center, Alabama; Dec. 1998.

D.A. Tidman; Slingatron: A High Velocity rapid Fire Sling; Journal of Propulsion and Power; vol. 18, No. 2, pp. 322-329; Oct. 2001.

Tidman, D.A.; Slingatron Mass Launchers, reprinted from Journal of Propulsion and Power, vol. 14, No. 4, pp. 537-544.

Tidman, D.A.; Constant-Frequency Hypervelocity Slings, Reprinted from Journal of Propulsion and Power, vol. 19, No. 4, pp. 581-587.

List of publications forwarded to the inventors by Derek Tidman. Except for those publications reference above (Nos. 3 and 15) and enclosed herewith, neither the applicants nor the undersigned attorney have copies.

* cited by examiner

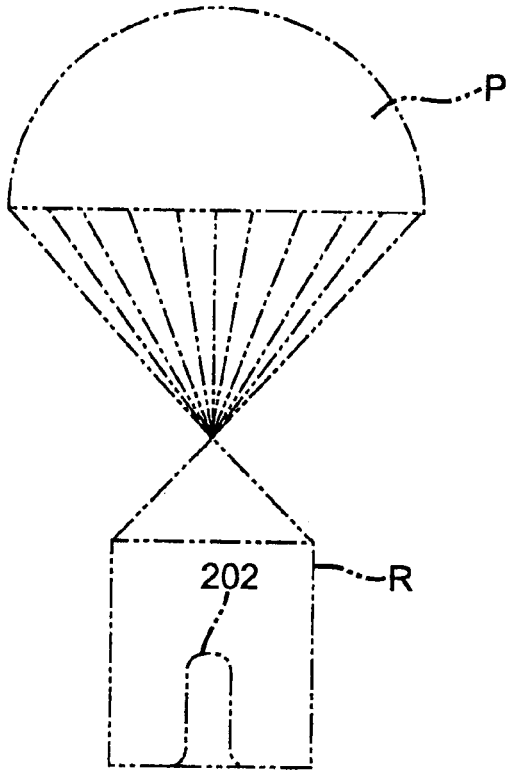
FIG. 15
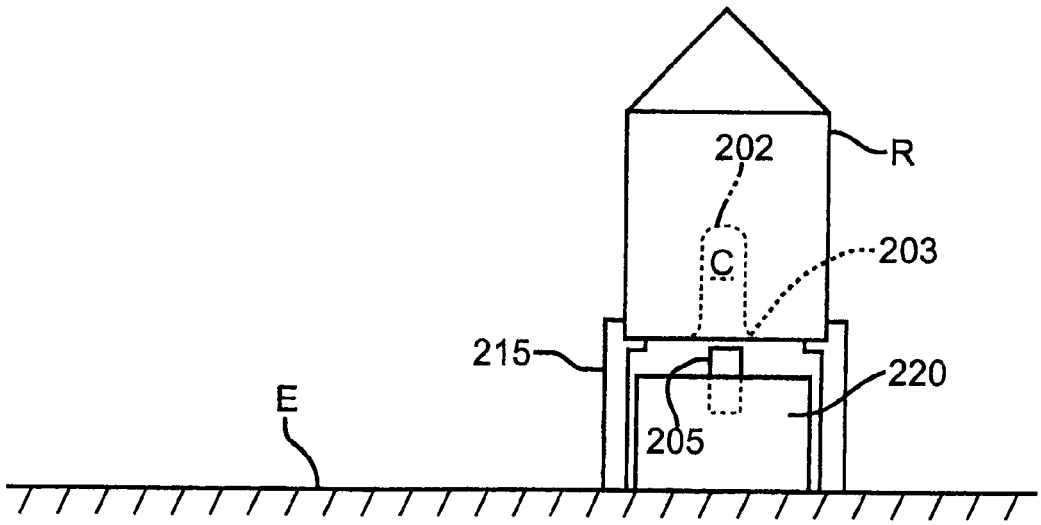

METHOD AND APPARATUS FOR MOVING A MASS

CROSS REFERENCE TO RELATED APPLICATION

This patent application is based upon and claims the benefit of U.S. Provisional Patent Application Ser. No. 60/383,632 filed May 28, 2002, and is a divisional of U.S. patent application Ser. No. 10/442,038 filed May 20, 2003 now U.S. Pat. No. 7,013,988.

BACKGROUND OF THE INVENTION

U.S. Pat. No. 5,950,608 is directed to a method of and an apparatus for moving a mass located in a track and moving the track itself to provide for acceleration or deceleration of the mass as it moves in and is projected out of such track. U.S. Pat. No. 6,014,964 is an improvement of the invention disclosed in U.S. Pat. No. 5,950,608 and utilizes a track having a spiral path. A mass located in the spiral track is moved by moving a portion of the spiral path where the mass is located substantially radially along a local radius of curvature of the spiral path. The mass may be accelerated by gyrating the spiral path at a constant frequency as the mass moves outwardly in the spiral path. The disclosures of each of the above-identified prior art patents are incorporated herein by reference.

Additional prior art, documented in numerous textbooks (engineering, physics and mathematics), also show other methods of accelerating a mass by rotational techniques. These public disclosures are also recognized. These techniques include the use of gears, belts, fixed and moveable structures, and non-contacting electromagnetic forcing functions.

SUMMARY OF THE INVENTION

The present invention is directed to a method and apparatus for moving a mass utilizing the broad inventions defined by the above-identified patents and other prior art coupled with new methods and apparatus for accomplishing specific objectives. For example, under one embodiment of the present invention, tools and methods for utilizing such tools for boring holes or abrading or cutting articles may be powered by one or more types of masses projected from a track of the above apparatus. These same embodiments can be accomplished with designs that are not derived from the above-identified patents. The present invention also directed to new products and articles.

Under another embodiment of the present invention, fuel may be delivered from a remote source to a desired location at a specific time to provide the energy and momentum required for propelling an object. Under the embodiments directed to the "remote fuel" concept, the delivered energy and momentum may be used to propel rockets, aircraft through in-flight refueling, mass transit vehicles, amusement park rides and tools, such as the previously mentioned hole boring tool.

For the purpose of the disclosure of the present invention, the apparatus disclosed in U.S. Pat. Nos. 5,950,608 and 6,014,964 will be referred to as a "Slingatron propulsion device" or simply "Slingatron".

As used herein, a mass accelerator means apparatus for accelerating a mass by rotational techniques and includes but is not limited to the Slingatron, to one utilizing a tube or track which is spiral, circular or other configuration of curved track for propelling the mass or an open channel having one of the above configurations for propelling the mass in a rapid fire manner. The tube, track or channel in which the mass is located is moved such that the area where the mass is located at a point in time is moved radially along a local radius of the curved path of the tube, track or channel. Rotational acceleration can be restricted to two dimensional motion as described in the above-identified "Slingatron" patents or it can utilize three dimensional motion.

BRIEF DESCRIPTION OF THE DRAWINGS

FIG. 15 is a schematic view showing another amusement park ride being propelled.

DESCRIPTION OF THE PREFERRED EMBODIMENT

Figure 1:
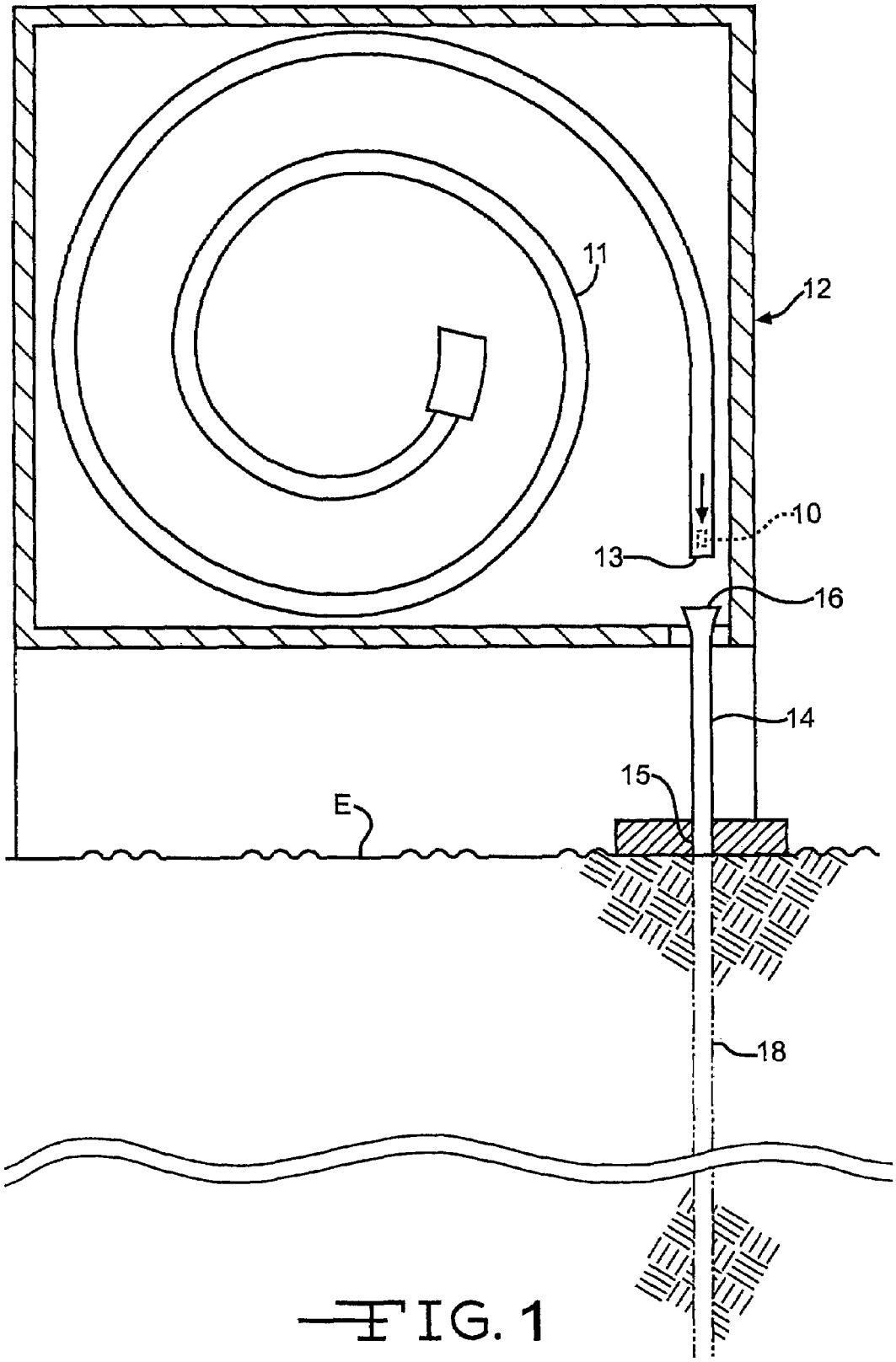
FIG. 1 is a view showing an embodiment for boring a hole with a projectile ejected from a Slingatron or other mass accelerator.

Holes may be drilled into the earth for a wide variety of purposes including oil exploration/drilling, placement of pipes and cables including fiber optic cables. In addition to boring holes in the earth, it is frequently necessary to bore holes in discreet articles such as, for example, a plate of steel or other material.

Hole Boring Tools

With respect to fiber optic cables, holes for fiber connectivity, are expensive. A simple, low cost boring tool for accomplishing such boring could result in an explosion of high bandwidth connectivity using fiber. This is commonly known as the "last mile" problem.

Under the present embodiment, high velocity and/or hyper-velocity slugs or projectiles can be propelled from modest Slingatron units or other prior art mass acceleration devices for propelling an article including ones that accelerate a mass by rotational techniques. These slugs can be vectored, via curved tubing, from an above ground mass accelerator to an underground "hole starting point". Once underground, the slugs can be used to "plow" a pathway from the exit of the curved tube of the mass accelerator to a destination, which could be miles away.

More elaborate designs have boring tools powered by fuel slugs (fuel can be more than just kinetic energy of impacts). Very elaborate designs are combinations of devices, used in some predefined manner, to provide a hole that is lined with a solid liner material forming a guide tube.

Simple hole boring, without any guide tube to control the direction of the slugs, will be employed wherever possible since it is the easiest to build. It is assumed that this probably will work best in solids, over short ranges like meters, and will use the slow slugs (lowest power and least likely to be "explosive" in nature). A plastic slug made of LEXAN® material moving about 5 kilometers per second will penetrate about 1 or 2 centimeters of hardened steel. Metal slugs need to be covered with a less thermally conductive surface to be useful at these velocities as experiments reveal a thermal transfer which melts highly conductive materials. Additionally, utilizing slugs with various density materials to impact the medium will have significantly different consequences which include increased angular dispersion of the slugs.

The potential for geometric dispersion of slugs propelled over greater distances may make it desirable to use guide tubes. However, for many applications, it is not necessary that the slugs or other projectiles be accelerated in a tube. It is also possible that they are accelerated in an open channel. The tube or channel in which the slugs or other mass are accelerated may have one of a wide variety of configurations including, but not limited to, spiral or circular. Pushing a guide tube through the "hole" created by the slugs is one way of providing a guide tube. The slug has an outside diameter equal to or less than the inside diameter of the guide tube it travels in. It is possible that medium expansions during the boring might exceed the outside diameter of the tube thereby permitting the tube to be pushed further into the medium. Additionally, there are forces associated with surfaces moving past one another, such as the tube being pushed through the bored hole, that might be larger than the forces provided by the boring equipment.

Expansive guide tubes may be used with slugs/projectiles. In this, the tube behaves like a snake that has eaten, meaning the tube expands as the slug moves through it, small enough to be fit inside the volume cleared by the slugs. Elastic materials that "return" the energy absorbed during expansion are potentially useful in these unique applications. It is possible to use the slugs/projectiles to ram the pointed closed end of such a tube through the medium.

It is also possible to have is a multi-tube design. A boring tool, with a diameter greater than the guide tube and the permanent conduit tube (which may or may not be the guide tube), is used to cut the pathway. The mechanism of cutting can be any of several including simple plowing with a tapered head or a rotating head motion like a drill bit.

The boring tool, a fixed mass object, is impacted by slugs/projectiles exiting the guide tube. While it may be possible to design a solution where the guide tube is "connected" to the boring tool, the length of guide tube that follows could become a dominate mass that would result in ever decreasing forward progress. Therefore, the forward progress of tubing in the hole may desirably be powered by something other than the motion of the boring tool—which is powered by the slugs/projectiles. Several powering schemes are possible including impact with a simple momentum exchange (however, the mass of the slugs might become a problem if they are retained in the boring tool), explosive slugs that are self consuming, releasing energy to the boring tool (something like a mini-gasoline explosion), or multiple slug types that interact with each other releasing the energy (possibly sent as alternating slugs in the guide tube).

Pushing a tube through the hole, if the hole is sufficiently large to prevent most wall surface resistance with the tube, requires a second device. This second device must be pushing on a surface that is larger in diameter than the slugs (otherwise the slugs would impact it somewhere along their pathway). The second device may be part of a two-part slug/projectile, with the outer annulus becoming the permanent tube, and the inner annulus becoming the slug that powers the impact boring tool. When the bored hole becomes very long, the ever increasing mass of the permanent tube, which could grow slower than the hole, will require additional means to balance the rate of progress.

One important aspect of these "not connected" devices is to assure that they do not get too dissociated. Thus, some loose interconnection is provided. One concept for loose interconnection is to have a slide sleeve that engages whenever the boring tool moves more than a fixed distance ahead of the pushed guide tube.

Boring tool design considerations include the strength of the materials used. This is especially important for simple impacting slugs. Designs that do not consume the slugs have the following issues and potential applications. The slugs might be vectored slightly "off-track" and allowed to exit the boring tool, but not before discharging some fraction of its kinetic energy to the boring tool (resulting in the boring tool moving forward). The slugs might even cause an imbalance in the moments of inertia which could be used to generate rotation of the boring tool. The exit port could cause some of the material that needs to be moved to be pushed away, thereby effectively assisting the hole boring process.

Rotating boring tools need some coupling interface to the guide tube—which can be non-rotating (simple pushed tube). Uneven rotational rates could shear the tube.

One slug "division" design would employ an impaling spike which would break the slugs into pieces before they impact the medium in the front of the boring tool. The boring tool would be moved "forward" in this process. The slug would initially be the equivalent of a "shotgun shell". Upon impact with the spike, it would release the pellet-like elements from within. Due to the nature of the acceleration of the slug in the mass accelerator (where radial accelerations of up to millions of times gravity can be imparted to the slug during its transit within the accelerator), a pre-fragmented design for the slug might be difficult.

A slug consuming design may include expanding gases if explosive materials are used. Trigger mechanisms to explode the slugs will be provided. In the multi-tube concept, the use of gas products could be advantageous to keep the frictional load of contacting surfaces low. Expanding gases could also be used to bore the hole. Small openings in the boring tool's surfaces that move the medium could be used to weaken the medium. These holes would be very analogous to the openings used by the subdivided slug in the previously described "shotgun" approach.

The application space for hole boring is broken into various sizes, most are small in diameter. These small hole applications generally are useful in situations where the hole is needed for insertion of something after the opening is made. Other applications include extraction of fluids from reservoirs that are surrounded by solid mediums. Exploration for underground fluid, such as water, natural gas or oil, can be accomplished with small holes.

Fiber optic cable is a prime market for long distance hole boring. The distance can be many miles, between facilities, or from a "fiber head" to numerous locations (homes).

Referring to FIG. 1, there is shown a projectile 10 positioned in a spiral passageway 11 of a Slingatron apparatus 12 or other mass accelerator for ejection from an exit port 13. If desired, a guide tube 14 can be connected to or positioned in alignment with the exit port 13 to receive the projectile 10 to guide it in its movement to the desired site of boring. In those cases where a guide tube 14 is utilized, it is desirable that one end 15 be affixed to the site of the boring 18. The opposing end 16 may be affixed to the Slingatron 12. Physical attributes of the guide tube 14 should address the possibility that there could be relative motion between the one end 15 and the opposing end 16. Preferably, such opposing end 16 and adjacent portion of the tube 14 may be tapered from a larger diameter to a smaller diameter at said one end 15.

If desired, an additional tube or tubes may be positioned adjacent the one end 15 of the guide tube 14 and moved into the boring 18.

When the Slingatron 12 or other mass accelerator is positioned such that the slug or projectile 10 is projected out of the exit port 13 in a vertical direction, the axis of the guide tube 14 will be substantially vertical and the projectile 10 will form a small vertical hole 18 in the article being bored or in the earth E, if it is desired to bore a hole in the earth.

The slugs or projectiles 10 may be made of a wide variety of materials including ones which are consumed during the boring process such as plastics, ones which dissolve after a period of time such as ice, ones which self destruct such as ones containing explosives or ones which are interactive, mechanically or chemically with each other or with various components of the projectile itself.

Figure 2:
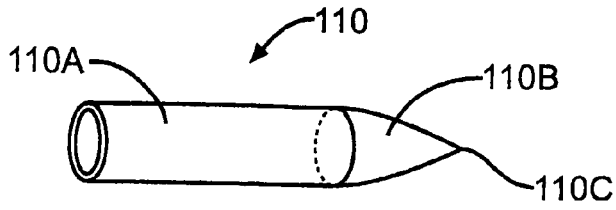
FIGS. 2-10 are views showing various designs of projectiles and boring bits pursuant to the present invention.

FIG. 2 shows an embodiment of a projectile 110 comprising a hollow shell 110A with a solid tip 110B formed of a plastic such as Lexan®, or other plastics, low co-efficient of thermal expansion material such as ceramics, and low co-efficient of expansion coatings on thermally conductive materials such as metals, graphite composites and other composites which will be consumed as the end of such tip 110B impacts to form the bore such as the bore 18 in FIG. 1. In the embodiment shown in FIG. 2, the outer diameter of the hollow shell 110A is substantially the size as the diameter of the tip 110B at the point of juncture between the shell and the tip. The tip 110B tapers to a pointed nose 110C. The external diameter of the hollow shell 110A is slightly smaller than the internal diameter of the passageway of the Slingatron 12 or other mass accelerator to permit such projectile 110 to easily move through the passageway 11 of the Slingatron 12 while being guided in the path defined by such passageway 11.

Figure 3:
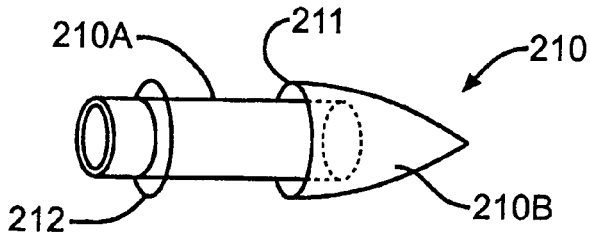

In the embodiment of FIG. 3, a projectile 210 has a hollow shell 210A with a diameter smaller than the diameter of the tip 210B at the trailing end 211 of the tip 210B. Under this embodiment, a support ring 212 is mounted on the hollow shell 210A near the trailing end to function as a support ring to assist in guidance as the projectile 210 is moved through the Slingatron 12 or other mass accelerator. The support ring 212 is particularly helpful in providing guidance where the mass accelerator utilizes an open channel rather than a closed tube for movement of the projectile 210.

Figure 4:
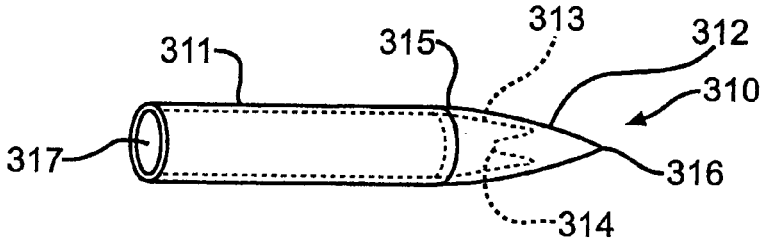

Now referring to FIG. 4, there is shown another embodiment of projectile 310 having a hollow shell 311 secured to a tip 312 having a chamber 313 with an impaling spike 314, the pointed end of which is facing away from the direction of travel of the projectile. The trailing end 315 of the tip 312 has a diameter substantially equal to the diameter of the hollow shell 311. As viewed in profile, as shown in FIG. 4, the impaling tip 312 tapers inwardly from a larger diameter at the trailing end 315 to a smaller diameter as it approaches the leading end 316.

An explosive 317 is positioned in the hollow shell 311. When the projectile 310 strikes the object to be bored with the leading end 316, the force of such impact will cause the explosive 317 to explode thereby causing the bore being formed to be enlarged. Explosive 317 can be used in the hollow shell designs of projectiles 110 and 210 described, respectively, with reference to FIGS. 2 and 3. Additionally, explosive 317 can be replaced with non-explosive materials.

Figure 5:
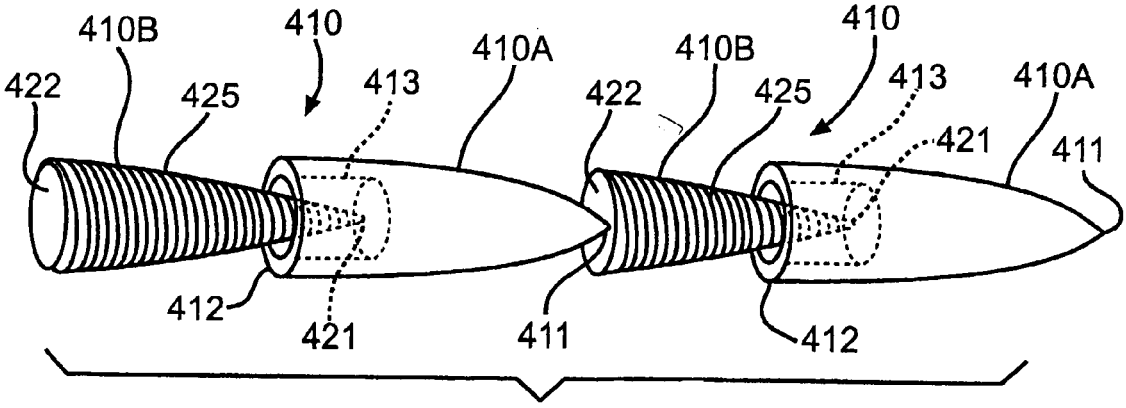

Referring to FIG. 5, there is shown yet another embodiment of projectile 410. In FIG. 5, there are shown two projectiles 410 adjacent one another. Each of the projectiles 410 includes a leading nose 410A extending from a tip 411 at the leading end to an enlarged trailing end 412. A pocket or chamber 413 is formed in the member 410A and extends axially inwardly from the trailing end 412. The second member 410B of projectile 410 is a cone shaped member extending from a tip 421 at its leading end and tapering to a larger diameter at its trailing end 422. The trailing end 422 of the second member 410B is substantially the same diameter as the trailing end 412 of the first member 410A. The second member 410B is provided with a series of helical or spiral cutting flutes 425 throughout the outer surface thereof from the tip 421 at the leading end to the trailing end 422. As the projectile 410 moves through and exits from the Slingatron 12 or other mass accelerator and into the bore being formed, the second member 410B is caused to rotate in the pocket 413. Such rotary motion of the second member 410B within the first member 410A causes both the first member 410A and the second member 410B to shred thereby clearing the pathway within the bore for the next projectile 410 to impact within the bore and further deepen such bore.

Figure 6:
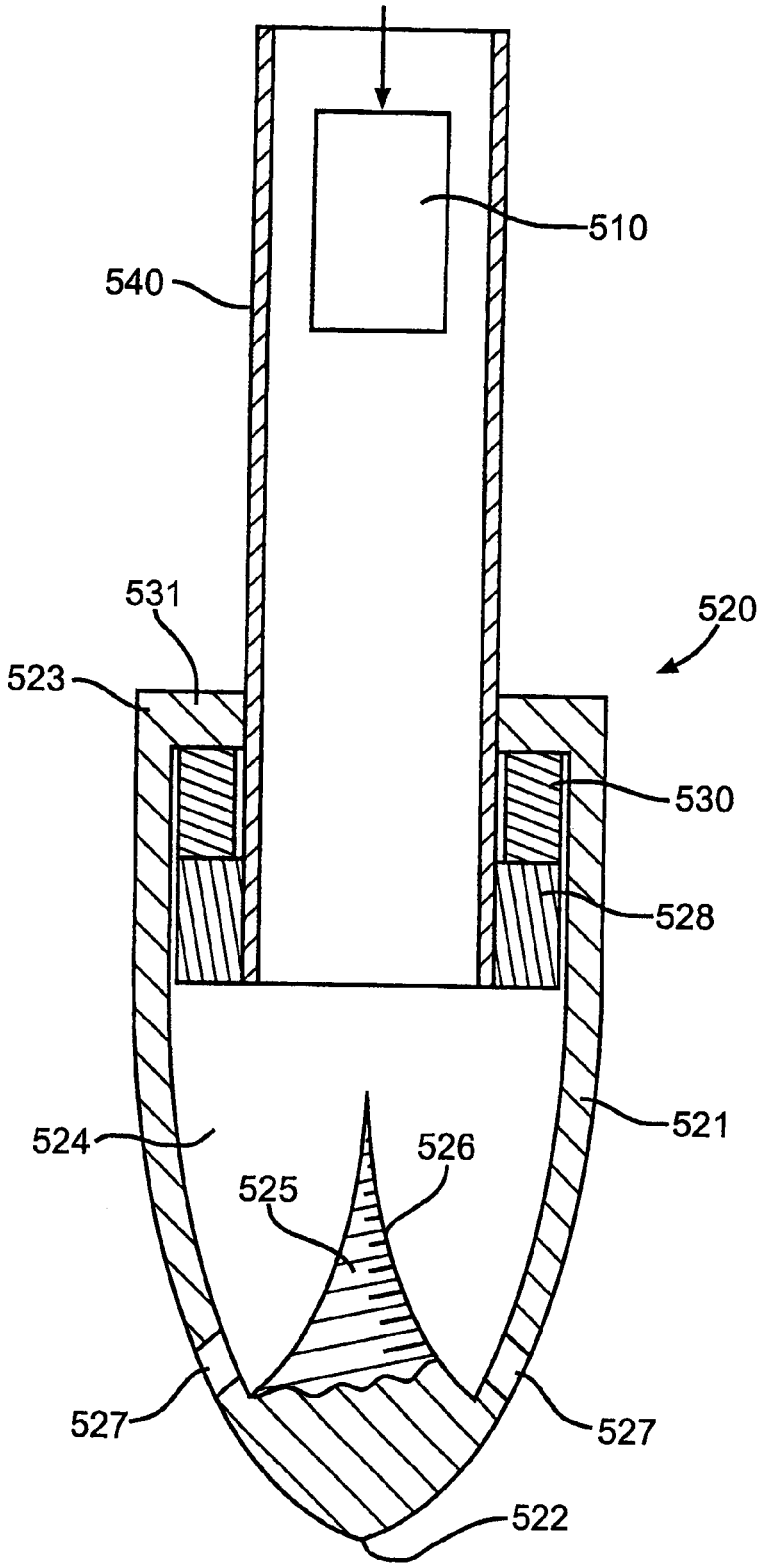

Referring to FIG. 6, there is shown a further embodiment utilizing a projectile 510 operating to impact a bore bit generally designated by the numeral 520. The bore bit 520 has attached thereto a tube 540 which is carried by the bore bit 520 as the bore bit is impacted by each successive projectile 510 to enlarge or deepen the bore. Under the embodiment shown in FIG. 6, the bore bit 520 includes a shell 521 defining a hollow housing extending from a leading end 522 defining a pointed tip to a trailing end 523. The shell 521 defines a chamber 524. Extending inwardly into the chamber from the tip 522 is an impaling spike 525 having a screw thread 526 formed on the outer surface thereof. A plurality of apertures or exit ports 527 are formed in the shell 521 in the area of the impaling spike. The tube 540 is fastened to a securing member 528 positioned within the shell 521. A bearing 530 is positioned between the securing member 528 and a radially inwardly extending flange 531 at the trailing end 523 of the shell. The bearing 530 permits the shell 521 and portions integral therewith including the leading and trailing ends 522 and 523, the impaling spike 525 with its threads and the flange 531 to rotate relative to the securing member 528 and the tube 540 supported thereon.

Under this embodiment, the projectile 510 ejected from the Slingatron 12 or other mass accelerator impacts the impaling spike 525 and the threads 526 extending outwardly therefrom to thereby cause the boring bit 520 to rotate as it deepens the bore being formed. Each projectile 510 propelled disintegrates upon striking the impaling spike 525 and its pieces are ejected from the exit ports 527. If desired, the outer surface of the shell 521 could be provided with helical or other configuration of recesses and threads defining cutting edges.

Figure 7:
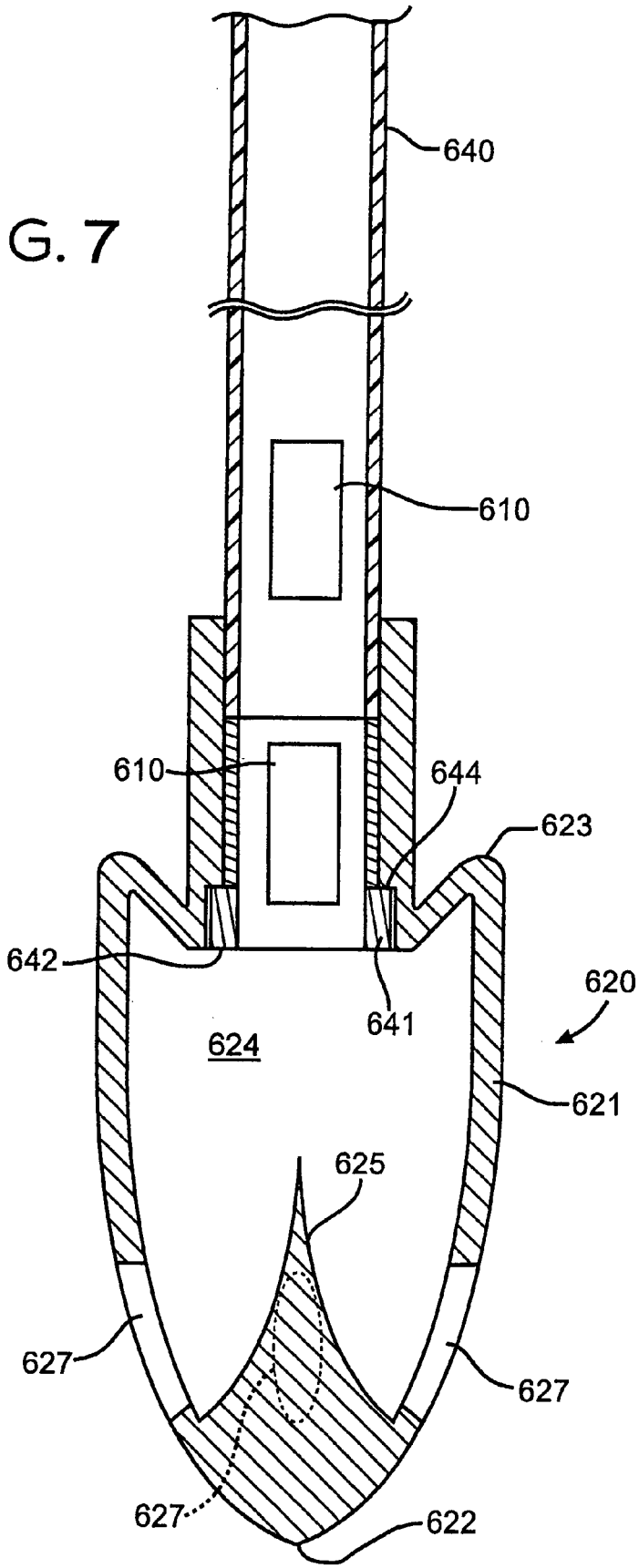
Figure 8:
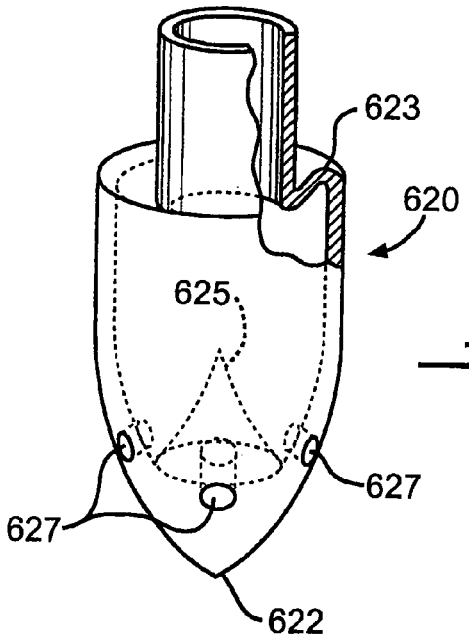

Referring to FIGS. 7 and 8, there are shown additional embodiments of boring bit 620. These are similar to the boring bit of the embodiment of FIG. 6 except that they do not rotate. Under these embodiments, there is provided a shell 621 extending from a leading end 622 to a trailing end 623. The shell 621 defines a chamber 624 and has a plurality of apertures or exit ports 627 in the vicinity of the leading end generally axially aligned with an impaling spike 625. Under this embodiment, the impaling spike 625 is not provided with threads such as the threads 526 of the embodiment of FIG. 6. The impaling spike 625 is positioned to be impacted by successive projectiles 610 moving through a tube 640 following ejection from a Slingatron or other mass accelerator. As the projectiles 610 disintegrate upon impacting against the impaling spike 625, they break into particles which are ejected through the exit ports 627.

The tube 640 has engaged to its leading end a connector member 641 having an outwardly extending flange or bearing surface 642. The bearing surface 642 is engaged by and supported on a radial shoulder 644 of the shell 621.

Figure 9:
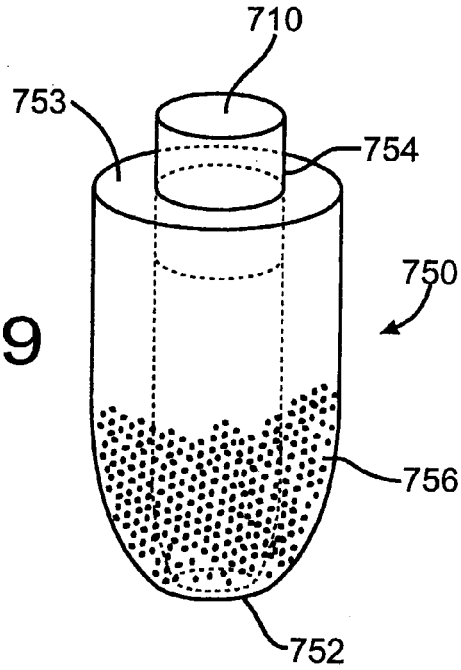
Figure 10:
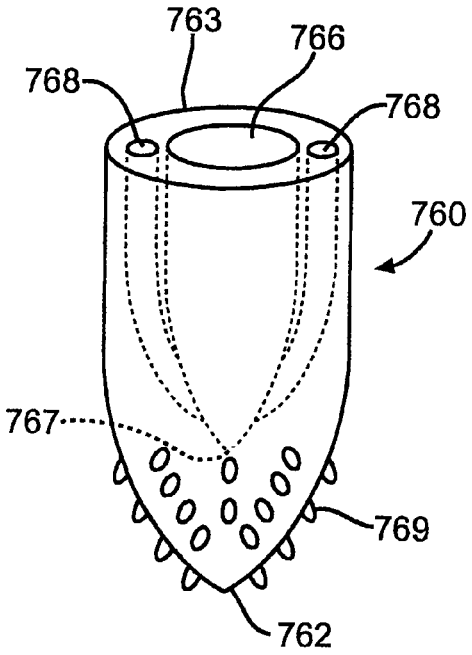

FIGS. 9 and 10 show additional boring bit designs. The embodiment of FIG. 9 shows a boring bit 750 extending from a leading end 752 to a trailing end 753 and having an axial passageway 754 extending therethrough from the trailing end 753 to the leading end 752. The axial passageway 754 is substantially cylindrical in the area adjacent the trailing end 753 but tapers inwardly to a size at the leading end 752 which smaller than the size of the projectile 710 intended to move through the axial passageway 754. Accordingly, as the projectile 710 approaches the leading end 752, it will be consumed due to friction and heat as it passes through the restricted portion of the passageway 754 at the leading end 752. The boring bit 750 is also provided with abrasive surfaces on its exterior surface 756 from the leading end 752 toward the trailing end 753. The abrasive surface 756 assists in the boring operation.

With reference to FIG. 10, there is a provided an embodiment of boring bit 760 extending from a leading end 762 to a trailing end 763. A chamber 766 extends inwardly from the trailing end 763 toward the leading end 762; however, the chamber 766 stops at an end 767 spaced from the leading end 762. A plurality of vent passageways 768 extend from a portion of the chamber 766 in the vicinity of its end 767 and extend to the trailing end 763 thereby providing vents for release of gas. The boring bit 760 is preferably used with a projectile formed of an explosive material. As the projectile is projected into the chamber 766 and impacts against the tapering sidewalls and the end 767, it will explode forcing the boring bit 760 deeper into the bore being formed. Preferably, the boring bit 760 is provided with external cutting teeth 769 adjacent the leading end 762.

The foregoing embodiments relating to abrasion, cutting, and hole boring may utilize the base Slingatron as set forth in U.S. Pat. Nos. 5,950,608 and 6,014,964 as the "drive" unit for the "projectiles", other mass accelerators or other drive mechanizations, gears, belts, fixed and moving structures and electromagnetic forcing functions.

The size, mass (density dependency), velocity and the preparation and complexity of the projectiles are the major variables and are designed based upon specific applications. Prime power to supply the kinetic energy to the Slingatron or other mass accelerator, and then to the projectiles, is a dominate feature of any implementation. Likewise, the deposited power (instantaneous) will determine the effectiveness of the design for the specific market application.

Size: The size of the projectiles may vary from as small as approximately 100 micrometers to several centimeters but no more than about 10 centimeters. The smallest projectile is probably the only application that uses just one projectile, namely, ice to crack kidney stones.

Mass: With the combinations of the smallest size and lowest density (less than one gram per cubic centimeter—water) bounding the low end, and largest size and highest density (heavy metal at several grams per cubic centimeter) bounding the other extreme, the mass range for the projectiles is between one microgram and one kilogram. These numbers can be adjusted by at least one or two orders of magnitude.

Velocity: While no practical limits are truly known, the upper limit probably is around 5,000 meters per second (5 Km/s). At that velocity plastic slugs will cut hardened steel.

Preparation: Where no limits are defined, two factors are known about surface properties of the projectiles. If the exterior projectile surface that is sliding on the tube is non-conductive, then the heat transfer is minimized and the projectile transits the tube with a solid form. Some fractional mass of the projectile is sacrificed to provide the "gas bearing" that allows for the velocity increases during transit.

Complexity: Plastic cladding of metal slugs/projectiles is one design being evaluated. Ice (frozen water) is believed to be a practical replacement for plastics for some applications. Slugs can be simple or complex designs with varying functions like a deep burrowing innermost dense metal surrounded by a lower density sheath which is in turn covered with a sacrificial plastic gas bearing material.

Abrasion applications for the present invention may include generally the "sand-blaster" and chemical etcher/cleaners, and to a lesser degree the "hammer" markets. Jackhammer functions may be replaced with cutting and abrasion tools using high velocity projectiles including but not limited to a supersonic sand-blaster. Any air-driven sand-blaster can be replaced with a Slingatron or other mass accelerator driven design. The advantages of the mass accelerator driven design and high velocity designs for sand blasters include a wide range of particle sizes and wide variety of materials for the particles.

One application of the present invention is removal of residual hardened concrete from concrete trucks. Such removal may require several projectile directing guide tubes. These guide tubes are the unique applicators. Possible configurations are dependent upon the configurations of openings in the drum of the concrete mixing truck. Addition of more openings will effect the number and shapes of the guide tubes. Using existing openings will result in tubes with straight and bent configurations, and possibly one or more rotational axes.

Multiple guide tubes, inserted only through the "charge/discharge" port of the mixer truck, would suffice. One guide tube would direct projectiles toward the surfaces facing the "charge/discharge" chute, while a second guide tube with a semicircle end fitting would direct projectiles at the opposing surfaces. Each of these guide tubes would have rotational capability with respect to the drum's axis of rotation, to cover all angles representing the definition of the surfaces with respect to the plane defining the "charge/discharge" opening. Coverage of these angles could be accomplished by compound rotations of the guide tube and the mixer drum, or by just rotating one of these with respect to the other being fixed.

Use of the drum's side hatch provides a different geometric relationship between the guide tube exit port and any surfaces inside the drum. Many physical configurations of mixer drums exist. Each has different opening relationship to the surfaces that need to be "cleaned".

Kidney stone breaking by simple collision by a fast moving ice chip is the one application which may utilize a single shot feature. The guide tube is a needle, placed inside the person, against the stone. The fast moving ice chip has sufficient momentum to crack the kidney stone. Use of ice negates any chemical hazards to the body. It is vital that the guide tube be positioned correctly. With almost microscopic size, the needle diameter can be placed inside the patient with minimal disruption of surrounding soft tissue. Two projectiles hitting in opposite directions would act to prevent the stone from moving into the kidney. Accordingly, another embodiment is for two ice pellets, shot to impact the stone approximately at the same time.

Another use for the present invention is etching into surfaces with a variety of materials and velocities. With appropriate complex geometric guide tubes or channels many complex shapes can be etched. Etching can be at any angle with respect to the surface being etched. For polishing it is desirable that the angle be nearly parallel to the surface being polished.

Cutting applications for the present invention may include replacements for saws in cutting a wide variety of objects.

Wood cutting remotely is accomplished by allowing the guide tube to direct projectiles to a desired location much like a sight on a gun. The range can be a few feet or many tens of feet. Using light mass projectiles at high velocity permits the "feather-like projectiles" to fall harmlessly after depletion of the momentum of the projectiles in the atmosphere.

Light ice pellets would be very simple to make and use as would dirt.

For "heavy duty" applications, a different projectile mass can be used, with more momentum to, for example, cut a tree.

This same approach applies to virtually any industrial saw application; like concrete saws. Demolition of all kinds can be accomplished by use of the present invention.

Ice cracking, for ships, is a simple extension of the "tree cutter" design. Impacting the ice with sufficient localized force weakens the ice structure. It is practical to "attack" the ice from below as well as above the frozen surface. Since the ice has the water acting as a force pushing it upward, a crack from below could be more beneficial to cracking the ice.

Tree stump removal is a simple "erosion" by "etching" the material away. With proper angles of attack the stump can be 'cut' out of the soil.

Quarry rock cutting is accomplished by a small bore tool. The size of the cut is not as important as the simple fracturing of the rock structure. High velocity is preferred. Projectiles with high momentum (mass) with high length to diameter ratio will be the best choice.

Hole boring applications for the present invention include replacing drills for most long distance applications and mining related exploratory holes.

Small hole boring has many specific applications. Cutting into places after a structure is finished is a common problem during construction and, can be readily accomplished using the present invention. Cutting long distances in construction can also be performed as well as exploration of complex structures without major mass removal. Such exploration could exploration for minerals.

Guide tubes to the entrance point of the hole are simple and easy to imagine—less complex than most of what has been described.

Boring through materials for long distances might require a "gear-like" cutting bit (much like the conventional drill bit). Designs of various bits, using the momentum and energy of the projectiles, can get quite complex. The bit must cut with a diameter sufficient for the projectiles to pass through existing hole length without impacting, and yet be sufficiently light enough (mass) to not become too overwhelming in the exchange of momentum with the projectiles.

Once they arrive at the bit, the projectiles must be used or they become a mass that impedes progress in the hole boring. These projectiles can be explosive, shattered and allowed to escape through openings in the boring tool, or eliminated in some other fashion.

Projectile and drill bit interactions can be simple or complex. Every other projectile may act as an igniter of the previous, with simple ramming force as the cutting mechanism. In this case the bit might have a tapered point, to allow for the materials to be pushed out of the pathway of the drill bit.

Projectile and drill bit interactions can be constructed to allow for drill bit rotations, caused by the physical interactions. Impaling spike designs, that fracture the projectiles, can be spiral (like a cork screw) to generate rotational motion.

Additional complexities can be to force the exhaust and/or fractured pieces to exit at defined angles resulting in these forces acting upon the material in front of the drill bit, weakening and/or cutting their own pathways—which can be used as voids for the next cycle of the bit turning into the material.

In summary, almost any combination of drill design used with conventional systems can be applied with the projectiles.

The projectiles can be simple mass and momentum exchange, or they can be fuel to feed a more complex machine, such as, for example, a simple combustion motor.

According to another embodiment of the present invention, fuel may be delivered from a remote source to a vehicle to be powered by the fuel.

Applications for "Remote Fuel" include rocketry, aircraft in-flight refueling, mass transit, tools, and amusement park rides. "Remote Fuel" delivery applications are possible using the patented Slingatron described in U.S. Pat. Nos. 5,950,608 and 6,014,964 or other mass accelerator delivery devices. Delivery of energy and momentum at a desired location at a specific time are the goals of remote fuel concepts herein proposed.

In general the applications of interest are those where "Remote Fuel" can be competitive, or open new markets. Competitive markets are generally one of two classes; those where the amount of fuel used is extensive (rocketry, aircraft, and mass transit are classic examples) and those cases where distance between the source of energy and the application of the power are significant (deep drilling is an example). New markets are devices that have no known design in use, such as amusement park rides that lofts people carrying capsules to great heights, or propel them at high speeds for thrill seekers.

For rocketry the approach is not simply to add fuel to an existing tank as it empties, but rather to alter the designs of rockets. In the extreme design approaches, the rocket engines and fuel tanks can be eliminated. Rocketry attributes like fuel tanks and engines (artifact of the propulsion schemes employed) can be rethought to better exploit the potentials that Remote Fuel offers.

Aviation advances due to Remote Fuel could include lighter, more agile people-carrying crafts that rely upon air-tugs that are refuelable. Air-tugs can be customized for acceptance of fuel in-flight from mass accelerator launch sites, and either share that fuel (like combat aircraft do) or share their thrust via a tow-line.

Mass transit opportunities are generally aligned with cargo, but could be suitable for people. The concept is to build partially evacuated pipelines, have sleds that will 'slide/roll' through the pipeline under momentum exchange from mass accelerator projectiles. Keys to these designs are low air resistance (for example, the partial vacuum in a sealed tube), low frictional forces, and ready access to the power grid to provide the energy for the Slingatron or other mass accelerator.

Tools that rely upon long mechanisms for transport of motion derived from a power plant (engine+transmission as an example) can skip the intermediate connection and use remotely supplied fuel directly. Drilling for resources (water/oil etc.) is one example.

Amusement Park rides are smaller scale versions of either the rocketry or mass transit devices.

In all the forgoing applications, the assumption is that the fuel (which represents energy and subsequent momentum) can be delivered via some version of the basic Slingatron or other delivery mechanism. The form and actual delivery techniques are as unique as the applications.

Paradigm shifts will occur as the applications of Remote Fuel sink into the various designs that can be accomplished. Keys to these changes are engines and fuel canisters being removed from designs, new fuel combinations, especially those that rely upon catalyst. Some fuels are not oxidized, just impacting for the momentum transfer. Use of the traditional power grid to supply base Slingatron power, as a trade against all the power being in the chemical called the fuel is essential to all applications. Economics of cheap power from the grid is the motivation that can spring the remote fuel into the mainstream.

The general forms of the equations of interest are derived from first principles, with conservation of energy and momentum being the most significant factors. These equations, when applied to business models, and coupled with cost, will define the scope of interest in Slingatron or other mass acceleration driven remote fuel.

Rocketry

Rocketry has progressed based upon the rocket equation, which reflects the consumption of fuel that is carried inside a tank that rides with the engine. This equation has an initial condition that has a fixed initial mass that changes in a decreasing manner as the fuel is consumed. Acceleration, under a constant thrust from the engine, is ever increasing due to the ever decreasing mass, until the fuel is totally consumed, at which point the engine is stopped. Making a bigger rocket, say twice the size, does not give twice the performance. Adding more fuel for later consumption, making the rocket's fuel tank larger, has marginal return on actual rocket performance—the added fuel lowers the acceleration of the fuel burnt at the beginning because the rocket is heavier. This equation is in fact limited, in practical terms. Staging, discarding engines and empty fuel tanks of enormous rockets, is the only proven way to increase launch mass. The success of NASA's Apollo missions is due in part to staged rocketry; the added mass of more engines (each stage had its own engines) was offset by dropping empty tanks and larger engines used to burn the vast amounts of fuel at the beginning of the launch process.

Thus anything that effectively lightens the launch mass, such as "refueling in flight", will be a potential improvement.

However, the basic idea of what is an engine, and what are acceptable fuels, might need to be altered to effectively take advantage of the present Remote Fueling embodiment of the present invention. Adding traditional liquid oxygen or liquid hydrogen to an existing tank, via a Slingatron or other mass accelerator, is not obvious.

Rocketry with Remote Fuel is analogous to automobiles getting refills of gasoline. If the service stations for refills are properly located along the pathway of the automobile, then refills are easy. Unlike the automobile, the rocket does not actually need to stop for refueling with the use of remote fueling. The analogy of aircraft getting refueled in flight is probably a better example.

One design of a new rocket has no engine or fuel in the "rocket". In lieu of the engine and fuel, momentum absorbing surface (for example, similar to a blast shield) acts to accept the energy and momentum from the materials lofted by the Slingatron or other delivery device. The "engine" is an external combustion form where the fuel oxidation occurs in the open rather than in a pressurized chamber.

Possible Rocketry design concepts for Remote Fuel are;

1. ASCENT VERTICAL: Fuel is launched from below the 'engine' and catches up to the engine where it is consumed. The laser analog of this concept is the situation where the laser reflects off the bottom of a reflector dish, which acts to focus the energy. At the laser focus, the local atmosphere is rapidly heated and expands, causing a local pressure that increases and boosts the reflector dish higher. In the Remote Fuel analog the fuel is exploded just below the object being lifted, causing a pressure increase that expands and lifts the object. The velocity of the rocket can never be higher than that of the fuel bundles launched from below since they must catch up before detonation (oxidation). Unlike the laser with its atmospheric limitations (must have air to expand for the lift), the chemical by-products for the explosion can be or are the masses that exert the pressure. Numerous chemical configurations work without use of local atmospheric matter to complete the reaction. The trigger to explode the fuel can be external to the launch vehicle, such as a ground based pulse. The fuel is accelerated very rapidly in the mass accelerator and most electronics devices would not work after being subjected to those accelerations.

2. ORBITAL TRAJECTORY: Fuel is launched by a mass accelerator from location "A" into a ballistic trajectory, reaching a zenith approximately halfway to location "B" (the terminus point of the ballistic trajectory). Many fuel projectiles are launched, forming a string-like chain of fuel objects. As the first fuel object reaches point "B" it is exploded to release energy and momentum which is used to move the launch vehicle upward. Each subsequent fuel bundle reaches the launch vehicle at a higher altitude (and at a shorter trip time since the launch vehicle is speeding up along the flight pathway of the fuel bundles). The best way to imagine this device is to think of the launch object made from two funnels, where the wide ends are the "top" and "bottom" and the narrow necks are joined together. The "top" opening catches the fuel objects, directs them into the "explosion zone" and the "bottom" wide opening is the exit nozzle. If done correctly orbital motion can be imparted to the launch vehicle.

3. Some combination of an ascent solution where the fuels are coming from below to get the launch vehicle above the bulk of the atmosphere, the orbital trajectory approach to achieve orbit.

4. Multiple orbital trajectory fuel launch sites strung together to allow for longer acceleration pathways.

Because the Slingatron or other mass accelerator does the bulk of the lifting using power grid resources, the options for engine types and fuel combinations are numerous. Cost trades will dominate the non-rocketry applications because many combinations will provide technical solutions that work. Rocketry is one of the few, if not the only, applications that will eliminate some combination of fuels and engines designs.

Engines can be "internal combustion" or "external combustion" (as described above, the fuel never entered the engine, it was ignited and expelled out the exhaust nozzle) or something all together different. In a pure momentum exchange device there is no engine. Tools are well adapted to use this technique.

Fuels that are not traditional are dynamite, very unstable explosives (preferred that it be a two chemical event), almost any form of hydrocarbon and anything that explodes upon reaching a prescribed set of conditions. Fuel also has another attribute, maneuverability. Encased fuel can be made with surface features that allow for limited maneuvering.

Catalytic combinations are also a promising option.

In some cases, the desire is to reach a condition where the local molecular environment can be used either as a part of the fuel, or as the propellant. Aircraft use aerodynamic principles to achieve lift. Rocketry has no such analog. "Remote Fuel" applications can be enhanced through use of the atmosphere.

NASA studied a device called a Blast Wave Accelerator (BWA). BWA is a massive gun barrel (longer than a football field), with sequential explosive events timed to occurred as the payload transits the barrel. The flaws in this design are simple; at only 100 meters long the acceleration on the launch vehicle is too large, and the effects of the rapid acceleration make it impractical to extract much from the last few explosions.

Rather than being restricted to a 100 meters barrel (actual solution for the BW A was a 'virtual barrel') in which to perform all the accelerations to achieve the necessary velocity, it is possible and practical with Remote Fueling to place the explosives events in locations that reduce the acceleration to acceptable levels—and to capture all the positive effects. Under one embodiment, the Remote Fuel launch system would use a 1,000 kilometers long trajectory.

It is also practical to consider these remote rocketry fuel events in locations outside the gravity well of the earth.

Non-Rocketry

Under another embodiment of the present invention, Remote Fuel operations may be used for aircraft using smart and/or dumb fuel objects. Acceleration from a mass accelerator for aircraft can be significantly lower than for rockets due to lower velocity requirements. The lower velocity requirements permit the use of electronics on the fuel objects. Options for such remote fuel applications include direct usage by the passenger aircraft, transfer from the airborne fuel depot or a transfer of momentum via a tow with no transfer of fuel to the passenger aircraft.

A limited number of supersonic tow-craft could effectively reduce flight times for passenger craft. The duration of the tow could be limited, thus sharing the tow-craft between numerous passenger crafts. Supersonic flight is a fuel intense activity; thus, a small plane with just that purpose would be optimized.

Engines, and fuel spaces in the voids of airframes, and even fuel types may be altered to reduce cost. The bulk cost of getting fuel to its destination (which is the usage point) is accomplished by the Slingatron or other mass accelerator. This is true regardless of the remote fuel usage (with a tow-craft, or directly by the passenger craft).

If the fuel object is somewhat maneuverable, then remote aircraft refueling can be accomplished without a second aircraft.

Mass transit of bulk cargo can be accomplished using remote fuel. In an evacuated or nearly evacuated tube, the resistance to motion is limited to friction between the surfaces in contact. Very low friction surfaces are used everyday, including simple bearing. Engines or momentum exchange designs could power 'trains' that carry the cargo. Achieving velocities of 500 meter per second (1,000+mph) is reasonable. With a limited number of hubs the vast distances between specialized markets can be greatly reduced with respect to time.

Train tracks are ideal locations to place the tubes, particularly with lots of physical infrastructure existing.

Under another embodiment, amusement park rides offer opportunities of remote fueling. The idea is to loft a capsule to altitude using the ascent concept presented in the rocketry section. Once the altitude is reached the capsule is allowed to free fall to a safe landing.

With various capsule designs it will be possible to have direct falls, spiraling falls, tumbling falls, and falls of many different time duration. It is entirely possible to afford a modest amount of control to a trained person, like the glider plane.

Another equally interesting amusement park remote fuel ride would be a remotely fueled race car without an engine. The car rides in a tube designed to control the direction of the vehicle. Safety comes from no fuel to explode and no engine to maintain. Vehicles will be moving on one way pathways providing safety from collisions. The key to speed is a remote fuel exchange between a mass accelerator and a momentum capture device in each car.

This could ultimately be a prototype for a rapid transit design. In the extreme case where the friction from air resistant can be eliminated (vacuum tubes) the velocity can become quite large before the effects of structural limits prevent additional velocity gains.

Beamed Fuel Concept for Remote Fuel

This embodiment provides an alternative launch vehicle design strategy. The traditional calculations that are the basis of the rocket equation, the mathematical expression governing all existing launch systems designs, does not apply to this design strategy. All physical principles used in this design strategy have been proven many times, just not applied as a group for the express purpose of building a launch system. This is in contrast to the prior art in which all the fuel is provided in the launch vehicle, or attached devices like solid rocket motors (used by the Space Shuttle and many of the other "heavy lift" expendable launch vehicles).

This embodiment relies upon the fuel being transported separately from the payload.

In this design combustion or explosion events occur along the payload's pathway in a specially designed chamber that is part of the payload. This chamber corresponds to the 'engines' in other designs. These combustion and/or explosion events provide acceleration to the payload, allowing the payload to achieve orbit or escape velocity. Fuel supplied in this manner is not governed by the equations used to derive the rocket equation.

These fuel "entities" are transported by the kinetic energy from the Slingatron or other mass accelerator or delivery device and can be readily launched. Fuel that is properly staged in time, velocity and three-dimensional space along a payload's trajectory, can be used by the payload. Fuel entities launched in this manner use none of it's the stored energy or kinetic energy of the entity. Therefore, delivery of fuel in this matter is dramatically less expensive and less dangerous than using conventional fuels in a traditional booster.

Figure 11:
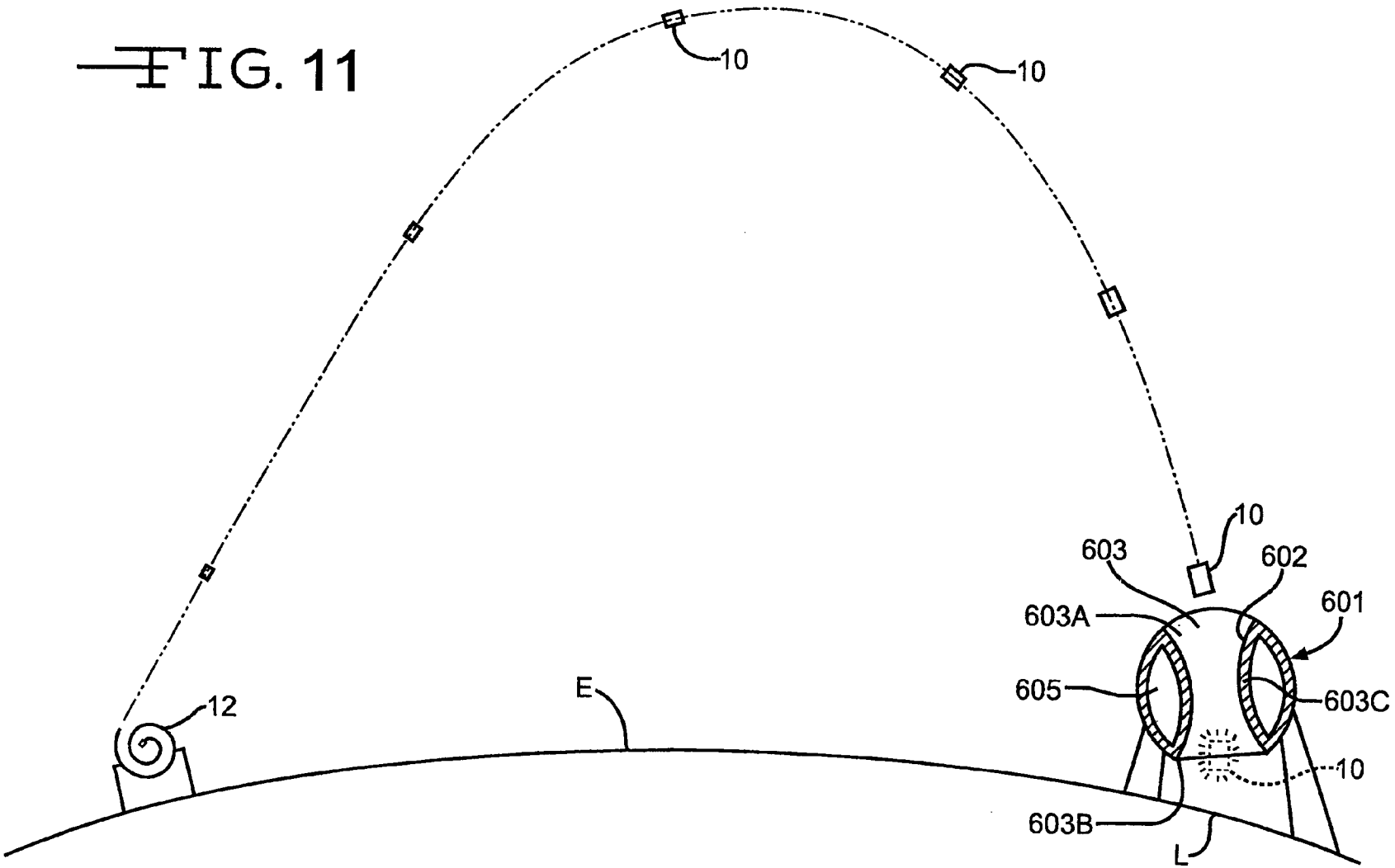
FIGS. 11 and 12 are schematic views showing projectiles being delivered to a launch vehicle for sub-orbital or orbital trajectory from a remote location.

Referring to FIG. 11, there is shown an embodiment of the remote fuel concept useable in propelling a vehicle into an orbital or sub-orbital trajectory. As shown, a Slingatron or other mass accelerator 12 is positioned at a location on the Earth E which is remote from a rocket launch site L.

A Slingatron or other mass accelerator 12 is positioned at a station on Earth and a launch site L is several hundred miles distant therefrom. The launch vehicle 601 has a central wasp waisted receptor 602 formed of metal or other material capable of withstanding the heat and forces generated upon it. The receptor defines a central passageway 603 having an enlarged receiving end 603A and an enlarged outlet end 603B with the central portion 603C therebetween being smaller. Encircling the receptor is a structure defining a chamber 605 in which is positioned a payload for the launch vehicle 601. The launch vehicle 601 may be supported on a support structure anywhere from a few feet to more than 100 feet above the Earth E.

The internal surface of the receptor defining the passageway 603 may be parabolic or cone shaped in the areas adjacent the ends 603A and 603B and, preferably, has a circular cross-sectional configuration.

Slugs or projectiles 10 of one of the types previously described are projected from the mass accelerator 12 at a velocity and angle of projection coordinated with the projection path of the vehicle 601 such that the projectiles 10 may be received in the inlet end 603A of the wasp-waisted receptor 602 of the vehicle 601 and ejected from the outlet end 603B. An explosion initiator contained in the projectile 10 is activated as the projectile 10 passes into the passageway 603 of the receptor 602 causing an explosion which acts upon the parabolic or cone shaped surface at the outlet end 603B of the receptor 602 causing upward propulsion to the vehicle 601. As can be seen from FIG. 11, a plurality of projectiles 10, conceivably of the order of hundreds to hundreds of thousands delivered from one or a plurality of mass accelerator sites are utilized to be received in the passageway 603 to propel the vehicle 601.

Figure 12:
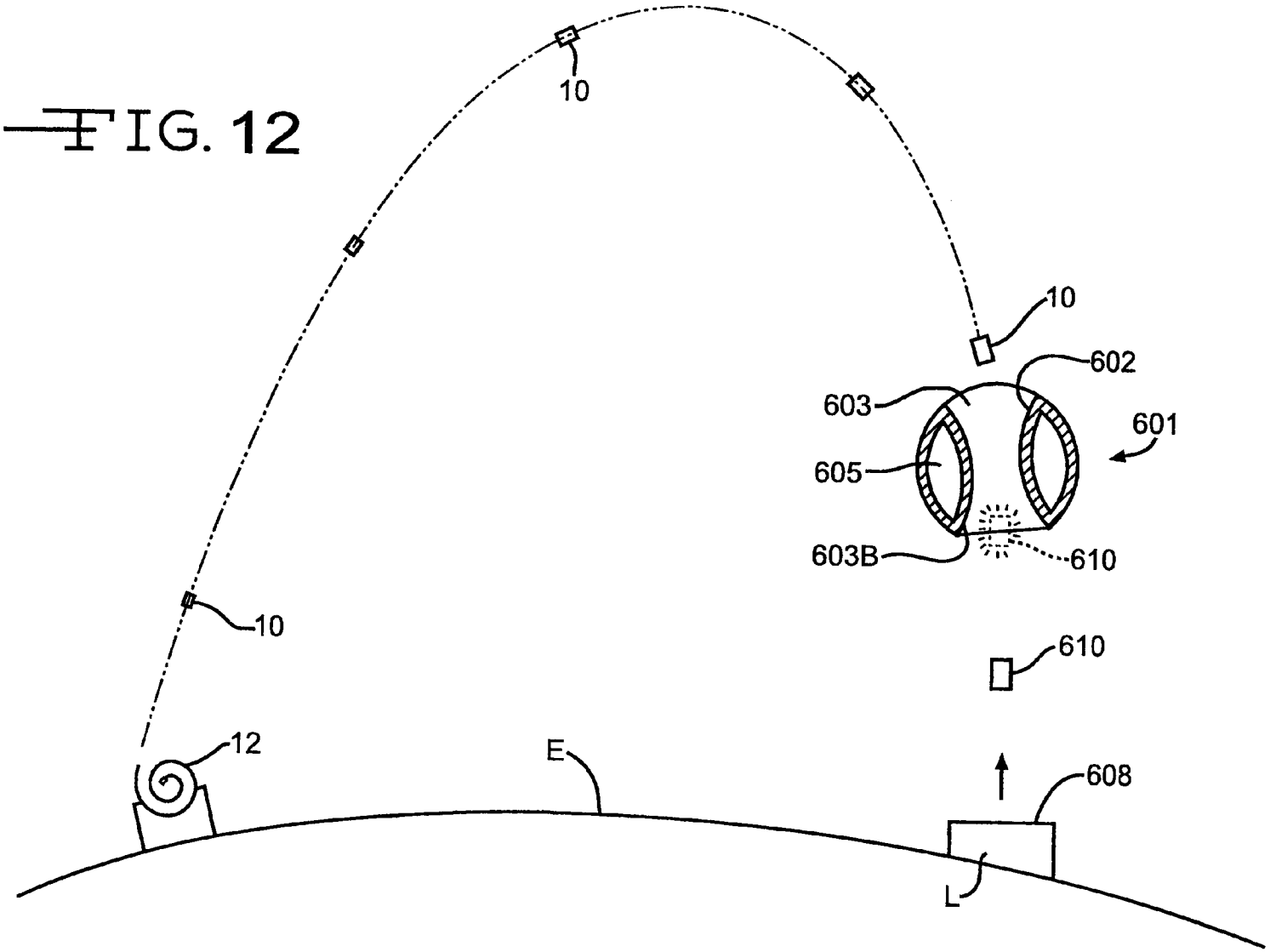

Referring to FIG. 12, there is shown another embodiment of the present remote fuel concept useable in propelling a vehicle into an orbital or sub-orbital trajectory.

Under the embodiment shown in FIG. 12, there is provided a launch vehicle 601 identical to the launch vehicle described with respect to FIG. 11 and a Slingatron apparatus 12 positioned at a location on the Earth E which is remote from the launch site L of the vehicle 601. The difference in the embodiment of FIG. 12 from that of FIG. 11 resides in the utilization of a prior art rotational propelling device 608 which propels slugs or projectiles 610 at a high velocity but not at a hyper-velocity projectile device such as the Slingatron or other mass accelerator 12 in order to effect the initial lift off of the vehicle 601. The propelling device can be a Slingatron propelling projectiles at velocities lower than hyper-velocity.

Following lift-off, the vehicle is propelled further by projectiles 10 from one or, preferably, several Slingatron or other mass accelerators 12 positioned great distances, hundreds of miles, from the launch site L.

Several key requirements drive all the possible design options for low acceleration profile launch. First and most important is path length which determines the acceleration profile, determines the acceleration profile, which for humans is limited to about three times the acceleration of gravity. Embedded in that acceleration profile is the need for a smooth acceleration; jerk (the first derivative of acceleration) is important, and may be as the maximum acceleration. Payload volumetric considerations are also important, as are practical matters like transiting through the earth atmosphere.

A Slingatron derivative design that does satisfy the key requirements is defined by a system that propels many (hundreds to thousands) energy/momentum units into the combustion/explosion chamber of a payload in flight. To achieve the pathway length, it is necessary to have at least 3-4 kilometers per second exit velocity (for the fuel entity) from the Slingatron or other mass accelerator. To keep the jerk small, the number of fuel entities must be very large.

Final configurations of mass accelerator designs and fire rates will be part of a cost trade once the application to space launch for low accelerations payloads (people) is defined. Many small Slingatrons may be cost effective when compared to one or a few large Slingatrons.

The use of remote fuel for launching and/or propelling orbital and sub-orbital vehicles is new and not suggested in the prior art. Since the fuel is not being launched as part of the payload vehicle it is essential that the fuel bundles be pre-staged or staged. In the pre-staged mode these bundles are launched before the payload, and either "fall into" the explosion or combustion chamber or are propelled into the chamber. In the staged scheme these bundles are provided on demand.

Pre-staged bundles are launched minutes to seconds before the payload. Possible scenarios are for one mass accelerator to loft bundles from a distance, allowing them to be consumed by the payload during their return to an earth intercept. These bundles lack the energy to achieve orbit. Another alternative is for several Slingatrons to loft bundles. One Slingatron could be used as described above and a second Slingatron used to provide fuel bundles directly below the payload. The second Slingatron's launches are only useful up the point where the payload is moving faster than the bundles being "slung" from below as described in the embodiment of FIG. 12.

Other Pre-Staged alternatives include launching 'intelligent' bundles that actually perform velocity and position adjustments to improve the overall system performance. For simple altitude scenarios it is possible to pre-stage and stage fuel using mass accelerator from a single location. While this does not afford orbital insertion (without lots of difficult fuel bundle maneuvering) it does represent an implementation with applications.

More than two mass accelerators can be used in the launch process. More than two sites can be used in a single launch.

If staged fuel were provided by the mass accelerator(s) at velocities sufficient to always exceed the velocity of the payload, it would be possible to utilize designs of the explosive or combustion chambers that are not possible with pre-staged bundles delivered from a remote site and passing through a combustion/explosion (i.e. momentum exchange chamber). For Low Earth Orbit (LEO), the staged fuel must have a Slingatron exit velocity above about 8 Kilometers per second (8 Km/s). This allows for orbit velocity of slightly less than 7 Km/s for the payload.

It is also expected that the remote fuel launch capability will achieve a cost to orbit that is orders of magnitude less expensive then any competing designs.

Another possible application is as very high speed human and cargo transport over very large earth distances. In the extreme case this device can be used to transport humans in a life support container half a world in less than I hour. At 6-8 Km/s circling the world is only a 100 minutes trip (40,000 kilometers circumference), thus half the distance is 50 minutes. This is typical orbital periods for LEO satellites.

Figure 13:
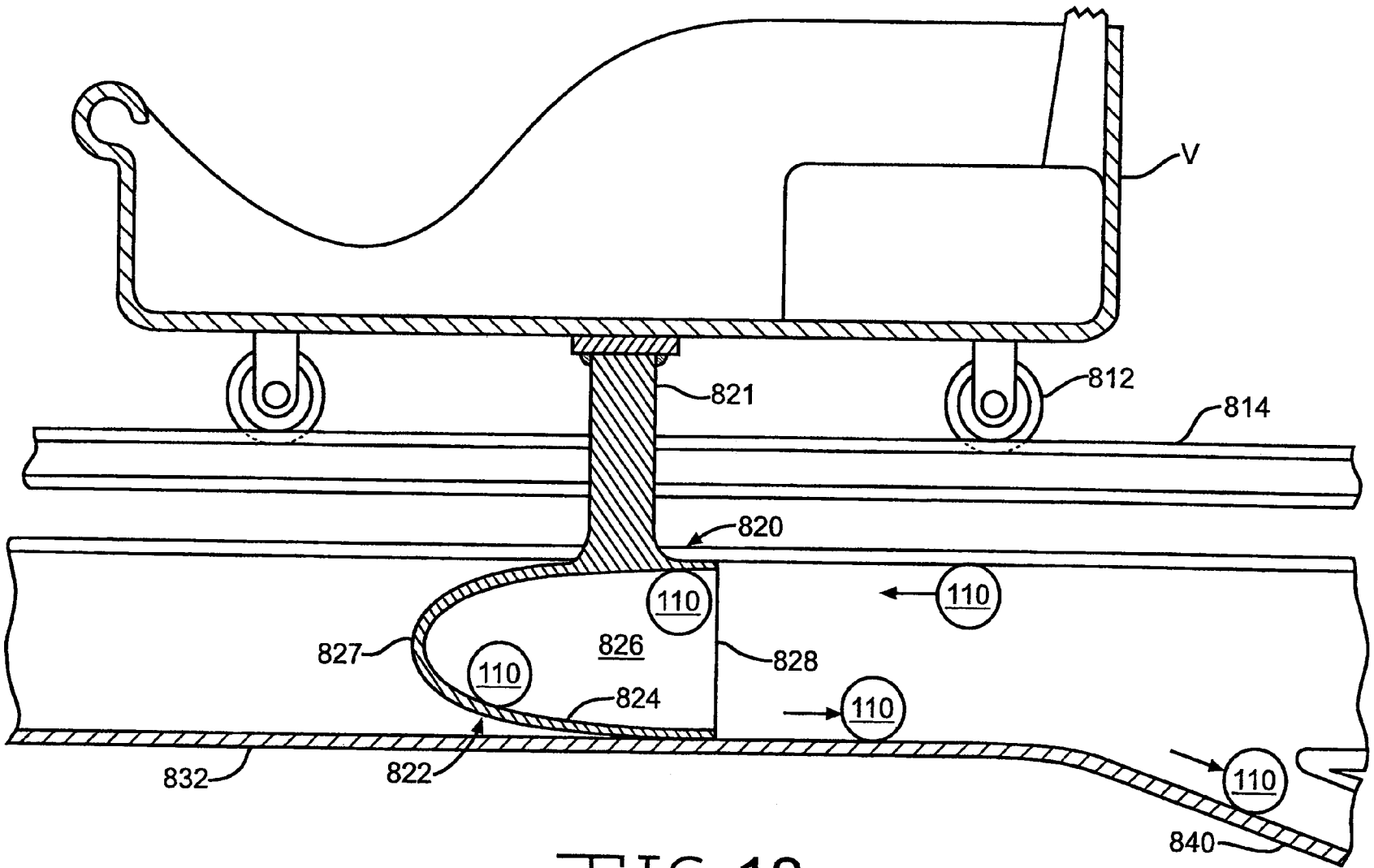
FIGS. 13 and 14 are schematic views showing an amusement park ride being propelled by a projectile in accordance with the present invention.
Figure 14:
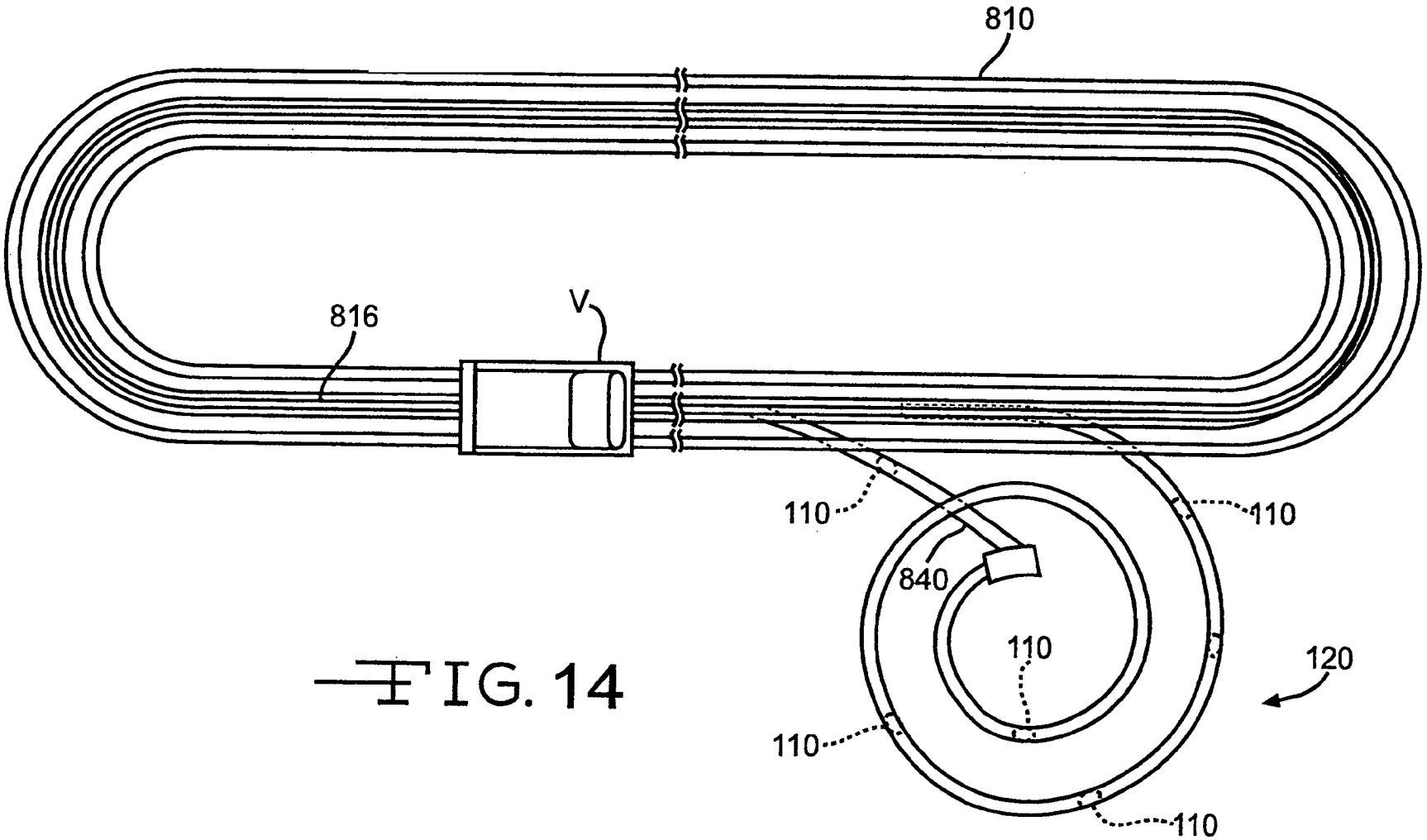

With reference to FIGS. 13 and 14, there is shown a further embodiment in which a Slingatron or any other rotational propulsion device 120 may be utilized to propel a vehicle in an amusement ride. There is shown a vehicle V mounted on a closed loop track 810. The vehicle V is provided with wheels 812 which roll upon a support surface 814 of the track 810. The track 810 has a central slot 816. Rigidly affixed to and extending downwardly from the vehicle V is a propulsion support member 820. The propulsion support member 820 includes an arm 821 affixed to and extending downwardly from the vehicle V. The arm 821 extends through the slot 816.

Formed integral with or securely affixed to the arm 821 is a projectile receptor 822. The receptor 822 shown in FIG. 13 includes a shell 824 defining a cavity 826 and extending from a closed leading end 827 to a trailing receiving end 828.

The receptor 822 is received in a tubular passageway 832 positioned below the track 810 and following a closed loop path similar to the closed loop path of the track 810. The rotary propulsion device 120 is positioned to project projectiles 110 from the rotational propulsion device 120 into the tubular passageway 832. Each projectile 110 will be received in the receptor 822. Successive impacts from successive projectiles 110 power the movement of the vehicle V.

Each projectile is sized to occupy less than one-half the size of the tubular passageway 832. The projectiles 110 are projected from the rotary propulsion device 120 so as to be near the upper portion of the passageway 832. The projectiles 110 will therefore enter the receptor 822 at its receiving end, begin a curved path as it approaches the closed leading end 827 and then, because of the closed end and its curved surface be projected in the opposite direction close to the lower surface of the tubular passageway 832 to a discharge passageway 840 which will carry such projectile 110 to the rotary propulsion device 120 for subsequent ejection along with others of the projectiles 110. Thus, the projectiles 110 may be viewed as having an arrangement akin to a bowling ball return passageway.

Referring now to FIG. 15, there is shown yet another embodiment for use in an amusement ride. Under this embodiment, there is shown a propulsion device 220 positioned on the Earth E. An amusement ride R is mounted above the propulsion device 220 on a support 215. The ride R has a chamber C having a closed upper end 202 and an open lower end 203. The surface defining the chamber C adjacent the lower end 203 is in the shape of a cone or parabolic curve. The propulsion device 220 propels projectiles 205 into the chamber C thereby carrying the amusement ride with the persons therein aloft to a predetermined distance. When the ride R reaches the predetermined distance, a parachute P inflates and lowers the ride R gently to the Earth E.

The above detailed description of the present invention is given for explanatory purposes. It will be apparent to those skilled in the art that numerous changes and modifications can be made without departing from the scope of the invention.

We claim:

1. A combination comprising:

(a) a plurality of projectiles;

(b) apparatus for successively moving said projectiles from one speed to a higher speed along an arcuate path including (i) means for moving a portion of said arcuate path where each said projectile is located substantially radially along a local radius of curvature, and (ii) an outlet for ejecting said projectiles therefrom; and (c) an article having an opening to receive said projectiles, said article having a surface upon which said projectiles may act to propel said article, said article comprising a space vehicle for orbital or sub-orbital flight, said space vehicle having a passageway for receiving said projectiles, said projectiles having explosive capability upon passing through or entry into said passageway, said passageway having an outwardly flaring surface upon which explosive forces resulting from explosion of said projectiles may act to propel said space vehicle.

2. A combination comprising:

(a) a plurality of projectiles;

(b) apparatus for successively moving said projectiles from one speed to a higher speed along an arcuate path including (i) means for moving a portion of said arcuate path where each said projectile is located substantially radially along a local radius of curvature, and (ii) an outlet for ejecting said projectiles therefrom; and (c) an article having an opening to receive said projectiles, said article having a surface upon which said projectiles may act to propel said article, said article comprising a mobile vehicle, said vehicle having a receptor with an open end for receiving said projectiles and a closed end against which said projectiles impact.

3. A combination according to claim 2 wherein said receptor has a curved inner surface configured such that projectiles are received in said open, impact said closed end and are ejected from said open end.

4. A combination according to claim 3 wherein said inner surface configuration permits successive projectiles to be ejected and received simultaneously.

5. A combination comprising:

(a) a plurality of projectiles;

(b) apparatus for successively moving said projectiles from one speed to a higher speed along an arcuate path including (i) means for moving a portion of said arcuate path where each said projectile is located substantially radially along a local radius of curvature, and (ii) an outlet for ejecting said projectiles therefrom; and (c) an article having an opening to receive said projectiles, said article having a surface upon which said projectiles may act to propel said article, said article comprising a launch vehicle positioned above said outlet of said apparatus.

* * * * *